United States Patent [19]

Masuda et al.

[11] 4,400,139

[45] Aug. 23, 1983

[54] OIL PUMP

[75] Inventors: Naosuke Masuda, Higashimatsuyama; Yoshio Suzuki, Menuma; Takeshi Ohe, Higashimatsuyama, all of Japan

[73] Assignee: Jidosha Kiki Co., Ltd., Tokyo, Japan

[21] Appl. No.: 258,242

[22] Filed: Apr. 28, 1981

[30] Foreign Application Priority Data

May 6, 1980 [JP] Japan ..... 55-60240

[51] Int. Cl.[3] ..... F04B 49/08

[52] U.S. Cl. ..... 417/304; 417/308; 417/310

[58] Field of Search ..... 417/300, 302, 304, 308, 417/310

[56] References Cited

U.S. PATENT DOCUMENTS 2,755,741 7/1956 Erskine ..... 417/304 X
3,366,065 1/1968 Pace et al. ..... 417/302
3,415,194 12/1968 Connelly ..... 417/304

FOREIGN PATENT DOCUMENTS 918122 2/1963 United Kingdom ..... 417/310

*Primary Examiner*—Richard E. Gluck
*Attorney, Agent, or Firm*—Flynn, Thiel, Boutell & Tanis

[57] ABSTRACT

A pair of pump bodies are disposed on the opposite sides of a rotor having vanes and a cam ring disposed in surrounding relationship with the rotor. These pump bodies serve the function of a sideplate and a pressure plate. The rotary shaft of the rotor is rotatably journaled in one of the pump bodies. A flow control valve is disposed in alignment with the axis of the other pump body, and a relief valve is disposed in surrounding relationship with the flow control valve. In this manner, the construction of various parts is simplified and the number of parts is reduced while simultaneously facilitating the machining operation. The overall length and the outer diameter as well as the weight of the pump can be reduced, advantageously reducing the manufacturing cost of the pump. The construction is further simplified by providing a cup-shaped casing around the pump body which functions as the pressure plate so that a space defined laterally of the pump body forms a pressure chamber on the discharge side of the pump.

4 Claims, 4 Drawing Figures

OIL PUMP

BACKGROUND OF THE INVENTION

The invention relates to an oil pump of the vane type which can, for example, be used in a power steering apparatus utilized to facilitate handling of a steering wheel of an automobile.

An oil pump of this kind generally comprises a rotor having a plurality of radially extending slits in which a plurality of vanes are slidably assembled, a cam ring having a cam surface of substantially elliptical form and disposed in surrounding relationship with the rotor, and a sideplate and a pressure plate disposed on the opposite sides of the combination of the rotor and the cam ring to define a pump chamber together with the cam ring. As the rotor rotates, the vanes disposed in the slits move in a reciprocating manner, with their outer ends disposed in sliding contact with the cam surface to provide a pumping function. An oil pump of the vane type permits its operation at a reduced noise level while utilizing a relatively simple construction and presents a high operational reliability and freedom from failures. Because of these advantages, it finds an extensive application in a variety of fields.

In the conventional construction of such an oil pump, the components of the pump including the rotor, the cam ring, the sideplate and the pressure plate are disposed in a space defined within a pump body, through which a rotary shaft of the rotor extends and is rotatably journaled. This increases the overall length and the outer diameter as well as the weight of the pump. In addition, it requires an increased number of parts, many of which must be machined in a troublesome operation. All of these factors contribute to increasing the manufacturing cost of the pump.

It should be noted that the problem is even more aggravated if a flow control valve controlling the flow rate of an operating or hydraulic oil discharged from the pump chamber and a relief valve which maintains the oil pressure below a given value must be integrally disposed within the pump body, as required in an oil pump which is used in a power steering apparatus, for example. Specifically, if the flow control valve and the relief valve are integrally mounted on the pump in surrounding relationship or laterally of the pump components, the outer diameter or the overall length of the pump body will further increase. Such result is particularly notable in many oil pump arrangements having a relief valve which is assembled into a flow control valve, thus presenting an increased overall length of the valve.

On the other hand, an oil pump of the type which is utilized in a power steering apparatus is subject to a number of limitations in view of the limited space available within an engine compartment and the desirability of reducing its influence upon the entire weight and the cost of an automobile. Therefore, it is apparent that there has been a need in the art to eliminate the described difficulties by providing an oil pump which is small in size and low in weight and inexpensive to manufacture.

SUMMARY OF THE INVENTION

Therefore, it is an object of the invention to provide an oil pump which is inexpensive to manufacture and has a reduced overall length and outer diameter.

This object is achieved by providing a pair of pump bodies on the opposite sides of a rotor containing vanes and a cam ring in which the rotor is disposed. The individual pump bodies serve as a sideplate and a pressure plate. The rotary shaft of the rotor is rotatably journaled in one of the pump bodies while a flow control valve is disposed in the other pump body together with a relief valve which is disposed in surrounding relationship with the flow control valve for maintaining the hydraulic pressure below a given value.

It is another object of the invention to provide an oil pump which achieves the described results and facilitates the machining, by providing a cup-shaped casing in surrounding relationship with the pump bodies so that a space defined laterally of the pump body may be utilized as a discharge pressure chamber of the pump.

Other objects, features and advantages of the invention will become apparent from the following description given in connection with the attached drawings.

DESCRIPTION OF PREFERRED EMBODIMENTS

Figure 1:
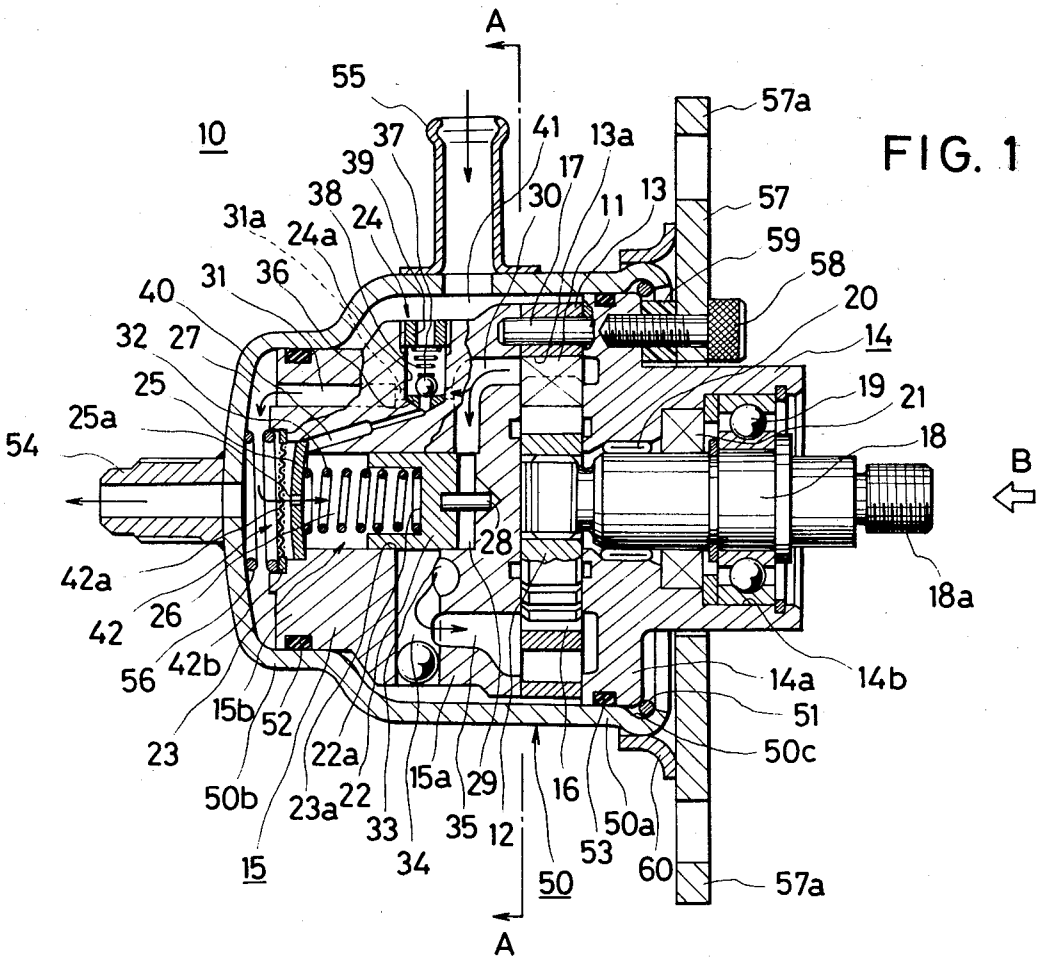
FIG. 1 is a longitudinal section of an oil pump according to one embodiment of the invention.
Figure 3:
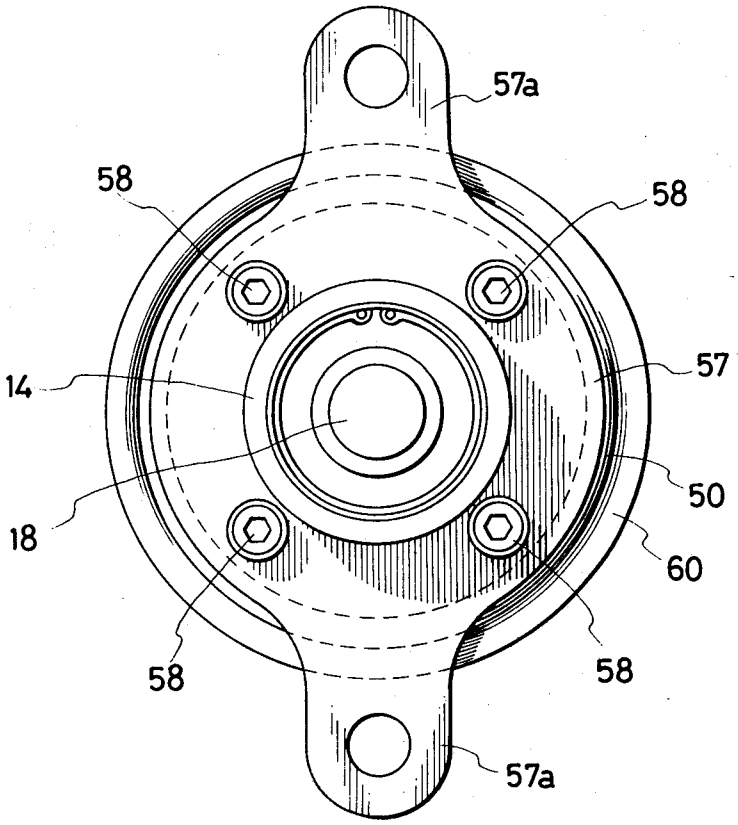
FIG. 3 is a side elevation as viewed in a direction indicated by an arrow B shown in FIG. 1.
Figure 2:
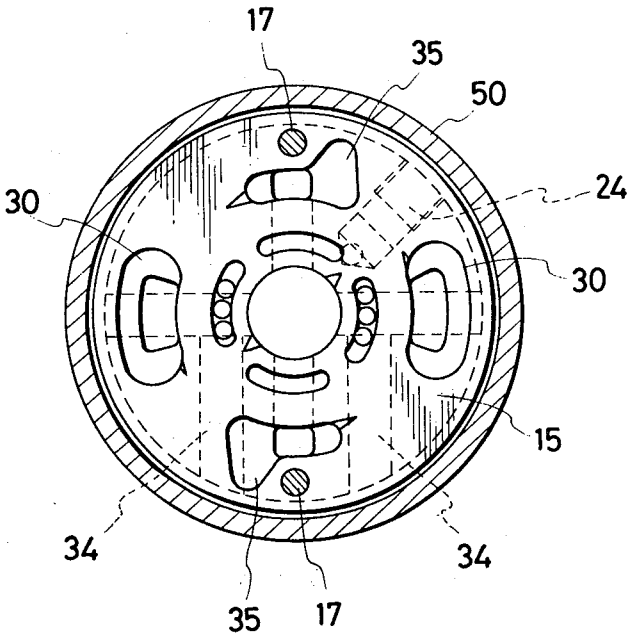
FIG. 2 is a cross section taken along the line A—A shown in FIG. 1.

Referring to FIGS. 1 to 3, there is shown an oil pump of vane type according to one embodiment of the invention. It is to be understood that the invention will be described hereinbelow as applied to a power steering apparatus. An oil pump generally designated by numeral 10 includes a rotor 12 having a plurality of vanes 11, which are surrounded by a cam ring 13 having a substantially elliptical cam surface 13*a*. A first and a second pump body 14, 15 are disposed on opposite sides of the rotor 12 and the cam ring 13 in abutting relationship with the latter. The combination of the first and the second pump bodies 14, 15 and the cam ring 13 defines a pump chamber 16 into which an operating oil from an oil tank is withdrawn and from which it is discharged. In this manner, the first and the second pump bodies 14, 15 serve the same purpose as a sideplate and a pressure plate which have been used in the prior art. A pair of pins 17 extending through the cam ring 13 are a close fit in both the first and the second pump bodies 14, 15 to prevent relative rotation between them.

The first pump body 14 includes a flange 14*a* of a diameter which is slightly greater than that of the cam ring and which abuts against one lateral side of the rotor 12 and the cam ring 13. The pump body 14 is formed with an axial bore 14*b* through which the rotary shaft 18 of the rotor 12 extends and is rotatably journaled in a ball bearing 19 and needle bearing 20. The inner end of the rotary shaft 18 is splined to the rotor 12 while its threaded outer end 18*a* has a pulley, not shown, mounted thereon which is coupled to an engine of an automobile through a V-belt. An oil seal is shown at 21.

The second pump body 15 is disposed in abutment against the other lateral side of the rotor and the cam ring 13, and has a larger portion 15*a* of a diameter which is substantially equal to that of the cam ring 13 and a smaller portion 15*b* having a reduced diameter.

Centrally disposed within the second pump body 15 is a flow control valve 23 for controlling the flow rate of a hydraulic oil from the pump chamber 16, the valve 23 including a spool 22 which is movable along the axis thereof. Radially outwardly of the flow control valve 23 is a relief valve 24 which maintains the hydraulic pressure of the oil from the pump chamber 16 below a given value.

More specifically, the flow control valve 23 is formed with a valve opening 23*a* aligned with the axis of the second pump body 15 and which opens into the side of the smaller portion 15*b*. At one end, the valve opening 23*a* is covered by a plug plate 25 having a damper orifice 25*a* centrally formed therein. Introduced into a low pressure chamber 26 defined between the plug plate 25 and the spool 22 is an operating oil from a pressure chamber 27 on the discharge side of the pump, which is defined laterally of the smaller portion 15*b* between the latter and a cup-shaped casing to be described later, through the damper orifice 25*a*. A pin 28 is fixedly mounted on the end plate of the spool 22 located nearest the rotor 12, and engages the inner end of the valve opening 23*a*, thus defining a high pressure chamber 29, into which part of the operating oil from the pump chamber 16 is introduced through a passage 30 which is formed in the second pump body 15. Intermediate its length, the passage 30 branches into another passage 31 which extends axially of the second pump body 15 and which opens into the pressure chamber 27. Intermediate its length, the passage 31 is formed with an orifice 31*a*, which produces a pressure differential between the oil pressure in the passage 30 and the oil pressure in the pressure chamber 27. A return spring 32 urges the spool 22 toward the high pressure chamber 29. To provide for an increased compressed length of the return spring 32 while reducing the overall length of the valve itself, the end of the spool 22 is formed with a recess 22*a*. The second pump body 15 is also formed with passages 33, 34, 35 which are utilized to introduce the operating oil from the oil tank into the pump chamber 16, and part of the passage 34 opens into the valve opening 23*a*. The passage 34 is normally blocked by the spool 22, but communicates with the passage 30 through the high pressure chamber 29 to define a circulation path for returning the operating oil from the pump chamber 16 to the suction side whenever the spool 22 is actuated.

The relief valve 24 is formed with a valve opening 24*a* which opens into the outer periphery of the larger portion 15*a* of the second pump body 15. A valve seat 36 is a press fit into the bottom of the valve opening 24*a*, and is formed with an aperture which is blocked by a ball 37, which is in turn urged against the aperture by a spring 38 having its other end abutting against a set screw 39. By adjusting the degree of threadable engagement of the set screw 39, the relief valve 24 can be preset to operate at a given pressure. The relief valve 24 normally communicates with the low pressure chamber 26 in the flow control valve 23 through a passage 40, and also communicates with the pressure chamber 27 on the discharge side through the damper orifice 25*a*. On the other hand, a pressure chamber 41 on the suction side of the pump is defined in the cup-shaped casing in a region of the outer periphery of the larger portion 15*a* into which the valve opening 24*a* of the relief valve 24 opens, thus returning the oil to the suction side whenever the pressure within the discharge pressure chamber 27 exceeds a given value.

It is to be noted that impurities such as iron powder or deteriorations may be contained in the operating oil from the discharge side of the pump which is supplied to the relief valve 24 through the passage 40, and may become deposited on the valve seat 36 or the ball 37, thus precluding their normal operation. For this reason, a conventional oil pump of this kind is provided with a filter which is disposed in a passage introducing the operating oil into a relief valve so as to remove foreign matter from the operating oil. However, the arrangement is susceptible to plugging because of the reduced diameter of the passage, requiring a frequent change or washing operation. To eliminate such problem, in the present embodiment, the passage 40 associated with the relief valve 24 opens into the low pressure chamber 26 of the flow control valve 23, and a filter 42 is disposed at the end of the valve opening 23*a* so as to be located outside the plug plate 25, based on the recognition that the operating oil is introduced through the damper orifice 25*a* formed in the plug plate 25 which is located in the larger end of the valve opening 23*a*. The filter 42 comprises a mesh screen 42*a* and its surrounding annular ring 42*b*, which is fitted into the end of the valve opening 23*a*. An increased diameter of the valve opening 23*a* as compared with that of the passage 40 reduces the likelihood that the mesh screen 42*a* may be plugged, while positively cleaning the operating oil. As a result, the operational reliability of the relief valve 24 is assured.

The components of the pump including the rotor 12, the cam ring 13, and first and second pump bodies 14, 15 are all contained in a casing 50 which is generally cup-shaped, as will be noted from FIG. 1. The casing 50 includes a larger portion 50*a* of an inner diameter which is substantially equal to the outer diameter of the flange 14*a* of the first pump body 14, and a smaller portion 50*b* of an inner diameter which corresponds to the smaller portion 15*b* of the second pump body 15 and forming the bottom of the casing. The casing can be simply formed by a press operation. Around the inner periphery of the opening end, the casing 50 is formed with an annular groove 50*c*.

The second pump body 15, the rotor 12 and the cam ring 13, and the first pump body 14 are sequentially received into the casing 50 in a stacked manner, with the second body 15 being located adjacent the bottom of the casing. A snap ring 51 is fitted into the annular groove 50*c* to lock the flange 14*a* of the first pump body 14. When assembled in this manner, the smaller portion 15*b* of the second pump body 15 fits in the smaller portion 50*b* of the casing 50, whereby the pressure chamber 27 representing the discharge side of the pump is defined between the bottom of the casing 50 and the smaller portion 15*b* while the pressure chamber 41 representing the suction side of the pump is defined between the larger portion 50*a* of the casing 50, the cam ring 13, and the outer periphery of the larger portion 15*a* of the second pump body 15. O-ring seals 52, 53 seal the respective pressure chambers 27, 41. A discharge pipe 54 and a suction pipe 55 are disposed to communicate with the pressure chambers 27, 41, respectively, through the bottom and the outer peripheral portion of the casing 50. A spring 56 is disposed within the pressure chamber 27 for urging the entire second pump body 15 against the rotor 12.

Disposed against the opening end of the casing 50 is a bracket member 57, with the first pump body 14 and the rotary shaft 18 of the rotor 12, which is journaled therein, projecting outward therethrough. The bracket member 57 is secured to the first pump body 14 by four bolts 58 which are circumferentially spaced apart. It will be noted that a collar 59 maintains a given spacing between the bracket member 57 and the first pump body 14, and also prevents an inward withdrawal of the snap ring 51. The bracket member 57 includes a mounting piece 57*a* extending outward for allowing the oil pump 10 to be fixedly mounted on a given location as in an engine compartment of an automobile. On its side facing the casing, the bracket member 57 is provided with a cylindrical fitting member 60 which externally engages the opening edge of the casing 50 in order to hold it under pressure. The purpose of the fitting member 60 is to prevent the opening edge of the casing 50 from being urged outward as a result of increased pressure within the casing 50 as the pumping action proceeds.

The oil pump 10 thus constructed has a number of features. Specifically, a sideplate and a pressure plate which are disposed on the opposite sides of the rotor 12 and the cam ring 13 in a conventional arrangement of oil pump and standing in the way to reducing the size of the pump are eliminated in accordance with the invention, by the provision of the first pump body 14 which rotatably carries the rotary shaft 18 of the rotor 12 and of the second pump body 15 containing both the flow control valve 23 and the relief valve 24, which bodies are disposed directly on the opposite sides of the rotor 12 and the cam ring 13 to serve the function of the sideplate and the pressure plate. In this manner, the construction of the various parts is simplified, permitting a reduction in the number of parts required and facilitating the machining thereof. In addition, the overall length and the outer diameter of the pump can be reduced, thus achieving a reduction in the size and the weight of the pump. A further reduction in the size and the weight of the pump is achieved by disposing the flow control valve 23 in a central region within the second pump body 15 which has a reduced outer diameter than the cam ring 13 and separately disposing the relief valve 24 in surrounding relationship with the flow control valve, and by reducing the axial length of the both valves.

In addition, a space formed between the second pump body 15 and the casing 50 which may be simply formed by a press operation is utilized to define the pressure chamber 27 of the discharge side, the internal pressure of which urges the pump body 15 against the rotor 12. In this manner, the construction is simplified while avoiding a troublesome machining operation. All these factors contribute to a reduction in the size, the weight and the manufacturing cost of the pump.

The oil pump 10 constructed in the manner mentioned above can be assembled together in a simple manner, by disposing the rotor 12, the cam ring 13, and the first and the second pump bodies 14, 15 in a stacked manner into the casing 50 after various parts have been assembled on these members, fixing the assembly by the snap ring 51 and fitting the bracket member 57 having the fitting member 60 around the opening end of the casing 50.

The oil pump 10 thus assembled performs a safe, stable and smooth pump operation in a manner to be described below. Specifically, as the rotor 12 rotates, the operating oil from the oil tank is drawn into the pump chamber 16 through the suction pipe 55, the pressure chamber 41 and the passages 33, 34 and 35, and is discharged therefrom by the vane 11 to be fed to the pressure chamber 27 of the discharge side through the passages 30 and 31 and thence supplied to a power steering device through the discharge pipe 54. Part of the operating oil flowing through the passage 30 is introduced into the high pressure chamber 29 of the flow control valve 23 while the hydraulic oil from the pressure chamber 27 on the discharge side is introduced into the low pressure chamber 26. As the number of revolutions of the engine of the automobile increases to increase the discharge flow from the pump chamber 16 above a given value, the pressure differential across the spool 22 causes it to move toward the low pressure chamber 26, whereby the operating oil introduced into the high pressure chamber 29 is returned to the passage 34 of the suction side, thus controlling the discharge flow from the pump. When the pressure within the pressure chamber 27 on the discharge side exceeds the given value, the relief valve 24 becomes operative, returning the operating oil of the discharge side to the pressure chamber 41 of the suction side, assuring the operational reliability of the various parts.

Figure 4:
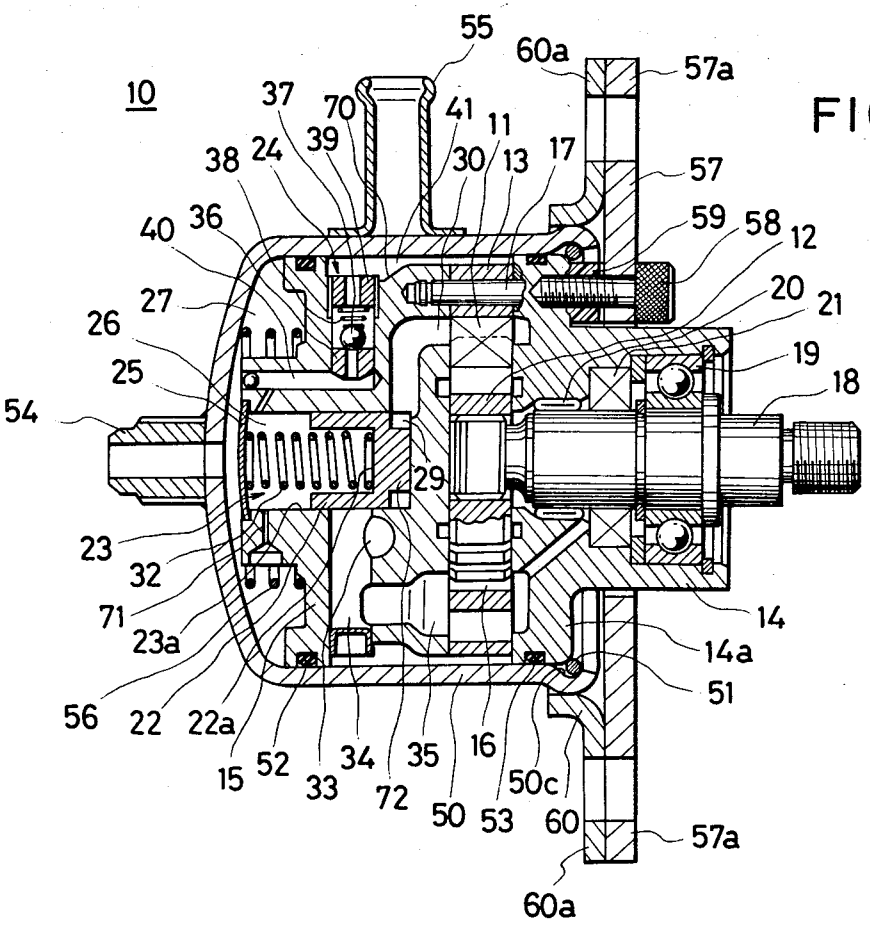
FIG. 4 is a longitudinal section of another embodiment of the invention.

It should be understood that the invention is not limited to an oil pump construction as exemplified by the embodiment mentioned above, but that the construction of various parts can be freely changed in a suitable manner. A modification is illustrated in FIG. 4 where an oil pump 10 includes a cylindrical casing 50 with a bottom, with pump components such as a cam ring 13 and a first and a second pump body 14, 15 of substantially equal diameter assembled therein. A pressure chamber 41 on the suction side is defined by the outer periphery of the cam ring 13 and an annular groove 70 formed in the outer periphery of the second pump body 15. A communication is established between the low pressure chamber 26 of a flow control valve 23 and a pressure chamber 27 on the discharge side through a passage 71 of a small diameter which extends diametrically through a lateral projection of the second valve body 15. In this instance, a plug plate 25 is formed by a blind plate. The flow control valve 23 includes a high pressure chamber 29 which is defined by an annular groove 72 formed in the end of the spool 22. Other parts are also suitably modified in a manner to facilitate their shaping operation. A fitting member 60 which is fitted around the opening end of the casing 50 includes a mounting piece 60*a* which is disposed in overlapping relationship with the mounting piece 57*a* of a bracket member 57, so that the mounting pieces 60*a*, 57*a* can be connected together as by bolts.

In the two embodiments described above, the relief valve 24 which is disposed in the second pump body 15 has its valve opening 24*a* terminating in the outer periphery of the pump body and its components assembled in a direction perpendicular to the flow control valve 23 which is centrally disposed in the pump body. However, it should be understood that the invention is not limited thereto, and that the relief vale may be disposed in parallel relationship with the flow control valve.

In the above embodiments, the oil pump 10 has been described as applied to a power steering apparatus, but it should be understood that the invention is not limited thereto in its application, but can be used in a variety of hydraulic instruments where a reduced size and weight is required for the oil pump.

While several embodiments of the invention have been shown and described in detail by way of illustration, it should be understood that they are illustrative only and not limitative of the invention. Thus, a number of changes and modifications therein will readily occur to those skilled in the art without departing from the scope and spirit of the invention. Therefore, it is intended that the appended claims cover all those changes and modifications as fall within the scope of the invention.

What is claimed is:

1. An oil pump comprising a casing having an inlet and an outlet for hydraulic fluid and having a pump inlet chamber adjacent said inlet and a pump outlet chamber adjacent said outlet, a rotor having a plurality of vanes, a cam ring surrounding said rotor, first and second pump bodies disposed on opposite sides of and in abutting relationship with said rotor and said cam ring, said rotor, said cam ring and said first and second pump bodies being disposed within said casing, said cam ring and said first and second pump bodies defining a pump chamber, said pump chamber having a suction side and a discharge side, said rotor being disposed inside said pump chamber for rotation therein to pump hydraulic fluid from said suction side to said discharge side, said rotor including a shaft which extends through and is rotatably supported in one of said pump bodies, a flow control valve for controlling the rate of flow of hydraulic fluid discharged through said outlet of said casing, a relief valve for maintaining the pressure of said hydraulic fluid discharged through the outlet of said casing below a predetermined value, said flow control valve and said relief valve being disposed in the other of said pump bodies, said other pump body having a first passage extending from said discharge side to said suction side of said pump chamber, said first passage having a high pressure chamber between its ends, said flow control valve being disposed in said high pressure chamber for controlling flow of hydraulic fluid through said first passage, said other pump body having a second passage extending from said discharge side of said pump chamber to said pump outlet chamber, said second passage having a first orifice of restricted size between its ends so that the pressure of the hydraulic fluid upstream from said orifice is higher than the pressure of the hydraulic fluid downstream from said orifice, said flow control valve having a low pressure chamber and an opening into said low pressure chamber, a plug plate covering said opening and having a second, damper orifice extending therethrough, said damper orifice communicating with said second passage at a location therein downstream from said first orifice so that said flow conrol valve is movable in response to the differential of the pressure in said high pressure chamber and said low pressure chamber, said other pump body having a third passage extending between and communicating with said low pressure chamber and said pump inlet chamber, said relief valve being disposed in said third passage so that said relief valve is opened when the hydraulic pressure in said low pressure chamber exceeds a selected value whereby to return the hydraulic fluid to said pump inlet chamber.

2. An oil pump according to claim 1, including a filter located adjacent to and covering said plug plate.

3. An oil pump comprising a cup-shaped casing having an inlet and an outlet for hydraulic fluid and having a pump inlet chamber adjacent said inlet and a pump outlet chamber adjacent said outlet, a cylindrical fitting member closing the open end of said casing, a rotor having a plurality of vanes, a cam ring surrounding said rotor, a pump body disposed on one side of and in abutting relationship with said rotor and said cam ring, said rotor, said cam ring and said first pump body being disposed within said casing so that the pressure in said discharge chamber urges said pump body against said rotor, said cam ring and said pump body defining a pump chamber, said pump chamber having a suction side and a discharge side, said rotor being disposed inside said pump chamber for rotation therein to pump hydraulic fluid from said suction side to said discharge side, a flow control valve for controlling the rate of flow of hydraulic fluid discharged through said outlet of said casing, a relief valve for maintaining the pressure of said hydraulic fluid discharged through the outlet of said casing below a predetermined value, said flow control valve and said relief valve being disposed in said pump body, said pump body having a first passage extending from said discharge side to said suction side of said pump chamber, said first passage having a high pressure chamber between its ends, said flow control valve being disposed in said high pressure chamber for controlling flow of hydraulic fluid through said first passage, said pump body having a second passage extending from said discharge side of said pump chamber to said pump outlet chamber, said second passage having a first orifice of restricted size between its ends so that the pressure of the hydraulic fluid upstream from said orifice is higher than the pressure of the hydraulic fluid downstream from said orifice, said flow control valve having a low pressure chamber and an opening into said low pressure chamber, a plug plate covering said opening and having a second, damper orifice extending therethrough, said damper orifice communicating with said second passage at a location therein downstream from said first orifice so that said flow control valve is movable in response to the differential of the pressures in said high pressure chamber and said low pressure chamber, said pump body having a third passage extending between and communicating with said low pressure chamber and said pump inlet chamber, said relief valve being disposed in said third passage so that said relief valve is opened when the hydraulic pressure in said low pressure chamber exceeds a selected value whereby to return the hydraulic fluid to said pump inlet chamber.

4. An oil pump according to claim 3, including a filter disposed adjacent to and covering said plug plate.

* * * * *